United States Patent [19]

Cook

[11] Patent Number: 5,004,204

[45] Date of Patent: Apr. 2, 1991

[54] STUDIO EASEL

[76] Inventor: Charles T. Cook, 357 Richfield Dr., Apt. 1, San Jose, Calif. 95129

[21] Appl. No.: 381,266

[22] Filed: Jul. 18, 1989

[51] Int. Cl.[5] ..... A47B 97/04

[52] U.S. Cl. ..... 248/449; 248/456; 248/460

[58] Field of Search ..... 248/449, 451, 452, 453, 248/455, 463, 456, 457, 460, 464, 465

[56] References Cited

U.S. PATENT DOCUMENTS

| | | | |
|---|---|---|---|
| 374,116 | 11/1887 | Cross | 248/449 |
| 410,226 | 9/1889 | White | 248/449 |
| 518,544 | 4/1894 | Faint | 248/449 |
| 694,979 | 3/1902 | Mueller | 248/464 |
| 2,501,019 | 3/1950 | Attick | 248/453 X |
| 2,524,898 | 10/1950 | Dumas | 248/449 |
| 2,526,527 | 10/1950 | Zander | 248/463 |
| 3,006,107 | 10/1961 | Tolegian | 248/449 |
| 3,058,706 | 10/1962 | Snell | 248/464 X |
| 3,304,045 | 2/1967 | Bethoney | 248/451 |
| 3,368,786 | 2/1968 | Bulman | 248/455 |
| 3,809,354 | 5/1974 | Phifer | 248/449 |
| 4,109,892 | 8/1978 | Hartung | 248/449 |
| 4,610,414 | 9/1986 | Schuck | 248/449 |
| 4,726,555 | 2/1988 | Andrews | 248/451 |

OTHER PUBLICATIONS

Dick Blick, 1989 Art Materials Catalog, pp. 118 & 119 on Easels, P.O. Box 1267, Galesburg, Ill. 61401.

*Primary Examiner*—J. Franklin Foss

[57] ABSTRACT

An upright frame or standard supports a canvas tray holder attached to a continuous endless V-belt stretched between two pulleys. A counterbalanced weight is attached to hold the canvas tray holder and workpiece in equilibrium, and is readily adjustable to any working height. The standard is mounted on a rectangular horizontal base frame with casters. It is supported vertically by an inclined cross brace assembly connected at pivot points to the standard and at holes on the horizontal base frame members for a vertical or an inclined position of the standard.

1 Claim, 3 Drawing Sheets

STUDIO EASEL

TECHNICAL FIELD OF INVENTION

This invention relates in general to studio easels that are rigid, non-collapsible and capable of supporting the extra large canvases as well as the smaller work-pieces, and, in particular, to studio easels that provide a quick and easy adjustment feature that permits raising and lowering the work-piece or canvas.

DISCUSSION OF PRIOR ART

Heretofore easels have been designed to support a canvas or workpiece in a position facewise to an artist upon which this artist creates a painting.

When a large canvas is positioned on an easel, the artist has to continually adjust the height of the canvas to paint comfortably on different areas of the canvas. Also in a detailed painting, the artist works sometimes many hours on a certain area of the canvas, and the frequent change from standing to sitting position is a welcome relief of the artist's arm and body. With less stress and strain, the artist produces a better painting.

Usually prior easel design included separately moveable top and lower canvas work-holder clamps which required separate adjustments in the selection of a desired working height and the workpiece had to be removed from its holder for each adjustment and then reset several times before the desired height was achieved.

This clumsy activity is a loss of time and concentration for the artist.

Over the years, several design features have been improved on the clumsy adjustable mechanisms of easels. The following list of patents discloses features which have been conceived.

| PATENT NUMBER | PATENTEE | ISSUE DATE |
|---|---|---|
| 4,610,414 | Schuck | September 9, 1986 |
| 3,759,482 | Wright | September 18, 1973 |
| 3,006,107 | Tolegian | October 3, 1961 |
| 518,544 | Faint | April 17, 1894 |

Schuck discloses an easel design that has a four-point rectangular base and supported always slightly in an incline position by two adjustable sliding members hinged at the top of the two upright segments and base.

The upright standard or frame is rectangular shape having two upright legs and a pair of cross members at the top and bottom.

Raising and lowering the work-piece is accomplished by a vertical sliding rack assembly consisting of a vertical center slotted segment and attached at the bottom a horizontal cross bar and adjacent to the side and bottom of vertical center slotted segment is attached a special mechanical slotted head, clutch, clutch plate, and clutch springs. This slotted head slides over a fixed vertical steel bar attached from a base cross member and extending up and through a guard guide attached to the side of vertical center slotted segment.

A vertical sliding rack assembly being retained slidably inside of standard by guides centered in top cross bar and guides at each ends of horizontal cross member enclosing inside edges of the outer legs of standard.

Adjusting the height of the work-piece is by applying pressure on clutch plate which releases the clutch from the vertical steel bar and the vertical rack assembly is free to fall or to be lifted up.

The top and bottom canvas holders are adjusted to various heights in the slot of the center slotted segment by bolts and wing nuts.

This easel has some desired features but does not have a vertical position.

This easel design requires special made parts and special tooling is required in manufacturing, making the easel very expensive to manufacture.

Also selected and expensive material is necessary to provide a quality product.

Wright discloses an easel design that uses friction to hold the work-piece in position. A single upright center support guide is grooved and a work holder rack and a top canvas holder have a slide bar that is secured in the groove by friction. This upright support is mounted on three legs set in a triangle position. Vertical and incline position is obtained by a hinge to slide plate adjustment on a rear leg. The tripod support type does not provide a stable mounting for easels. Special material is required and special tooling is required for the guide bar and internal slide bar which could be expensive. The work-piece has to be removed from its mounting to adjust the work-piece to a different height position which is awkward and time consuming.

Tolegian discloses an easel design that uses an electric motor to raise and lower the work-piece by a forward and reverse switch.

This electric motor is mounted on the center of a lower canvas holder and is geared to an upright toothed track which is between a pair of upright frames.

The two ends of lower canvas holder and the two ends of a top canvas holder have a pair of grooved wheels mounted on their outer ends respectively, which becomes a carriage holding the canvas in between and riding on the track or inter-edges of the two upright frames.

Tilting from vertical to incline position is provided by a hinge connection between base and upright frame. This easel provides many desired features, but is very expensive to manufacture. The easel is subject to electrical problems.

Special tooling and material is required for various parts, also selected and expensive material is required to provide a quality product.

Faint discloses an easel design with two upright incline segments or rails with double grooves on the inside and connected together by a pair of cross bars, one near the bottom and the other at the top ends respectively, and an incline rear leg hinged at the top and center of the top cross bar giving the easel a three-point incline stance.

A rectangular sliding frame, the two outer upright segments edges being tongued, fits into the front grooves of the inside rails respectively. This sliding rectangular frame includes two outer upright segments connected together by a lower shelf and a top cross member with a central vertical member connecting the top cross member and lower shelf. A bent wire wraps around central vertical member to hold the top of a canvas stationary. Raising and lowering the work-piece is accomplished by two cords that are attached to each lower ends of the sliding frame, then up and over a pair of pulleys or knobs secured near the top of each slide rails respectively and then passing down inside and attached to a counter-balanced weight or horizontal bar extending across the back side of the easel and the horizontal bar having both outer edges tongued fits into the back grooves inside the upright rails respectively.

This sliding frame is locked in place within the sliding rails by a pair of thumb screws that pass through the edges of the side rails respectively. This easel does not have a vertical position and the tripod type support is not as stable as the four-point support.

Manufacturing cost is prohibitive due to the close tolerances required in the tongues and grooves, slide bars, and outer rails, and any warpage in certain materials used would make this easel useless.

Also, selected and expensive material is required to provide a quality product.

The above listed patents provide means of holding and supporting the work-piece. The work-piece holders are mounted to a support bar and adjusted by various means in a vertical position.

The upright frames are supported on a four-point base with adjustment means for vertical to incline position or a combination upright frame and tripod type support always in an incline position.

While the objectives of the above mentioned patents are common, they have not achieved them in an efficient or economical manner.

SUMMARY—OBJECTS AND ADVANTAGES

My invention relates to improvements in studio easels by providing a design that has many advantages and improvements over prior studio easels.

The first object is to provide an easel which has a strong and simple construction with a very stable four-point base support that is necessary when the larger canvases or work-pieces are employed, yet one that is easy to move around to any location. The construction is a very important object of the invention in that all of the material can be purchased directly over the counter and no special tooling is required for making the individual parts or for their assembly. The material can be wood, metal, or the combination of the two. However, angle bars would be most suitable. This unique design feature and combination of hardware makes this easel extremely durable and very inexpensive to manufacture.

Another object is to provide a pivot point between the easel frame and base to permit a method for adjusting from vertical to incline position of the easel frame if desired.

Another important object is the easel can be completely disassembled for shipment or partially disassembled for storage.

Another just important object is to provide the artist a method where he can adjust the work-piece to a selected working height in a vertical or incline position without having to release the work-piece from its mounting.

However, the most important object is to provide a quick and easy method for raising and lowering the work-piece by simply lifting up or pushing down on the center of the canvas tray holder which is held in equilibrium by a "V" belt stretched between two pulleys and a counter balanced weight attached.

The total load or force which the canvas tray holder can take before vertical movement is determined by the friction between the surfaces of the two sides of the "V" belt and the two pulleys respectively and the tension adjustment of the "V" belt and this force is much more than the weight of several large canvasses or work-pieces.

Therefore, the canvas tray holder, canvas, and top canvas holder is in equilibrium at all times.

The length of the "V" belt determines the vertical travel of the canvas tray holder which includes from the sitting position to the standing position of a normal person facewise to the work-piece or canvas.

Further objects and advantages of my invention will become apparent from the following description of the drawings and ensuing embodiment of the invention.

BRIEF DESCRIPTIONS OF THE DRAWINGS

FIG. 1 a front view of the standard in the vertical position.

LIST OF REFERENCE NUMERALS

11 Holes (Vertical Position) (2)
12 Pivot Points (2)
13 Quick Release Pins (2)
14 Holes (Incline Position) (2)
15 Casters (4)
16 Horizontal Base Frame Members (2)
17 Base Support Shelf
18 Horizontal Base Ends Members (2)
19 Rear Brace Member
20 Cross Brace Members (2)
21 Incline segments (2)
22 Upright Segments (2)
23 Brace Members (2)
24 Vertical Angle Bars (2)
25 Cross Bar
26 Bracket (Lower)
27 Bolt
28 Wing Nut
29 Washer
30 Nut
31 "U" Bracket
32 Pulleys (2)
33 "V" Belt
34 Weight
35 Clamps (4)
36 Brackets (Top) (2)
37 Tray Vertical Guides (2)
38 Rectangular Slidable Block
39 Angle Bracket
40 Canvas Tray Saddle Block
41 Bolt
42 Wing Nut
43 Washer
44 Nut
45 Canvas Tray Holder
46 Top Slidable Block
47 Bolt
48 Nut
49 Washer
50 Wing Nut
51 Top Canvas Holder
52 Work-piece Indicated in Phantom Lines

DETAILED DESCRIPTION OF THE PREFERRED EMBODIMENT

Figure 1:
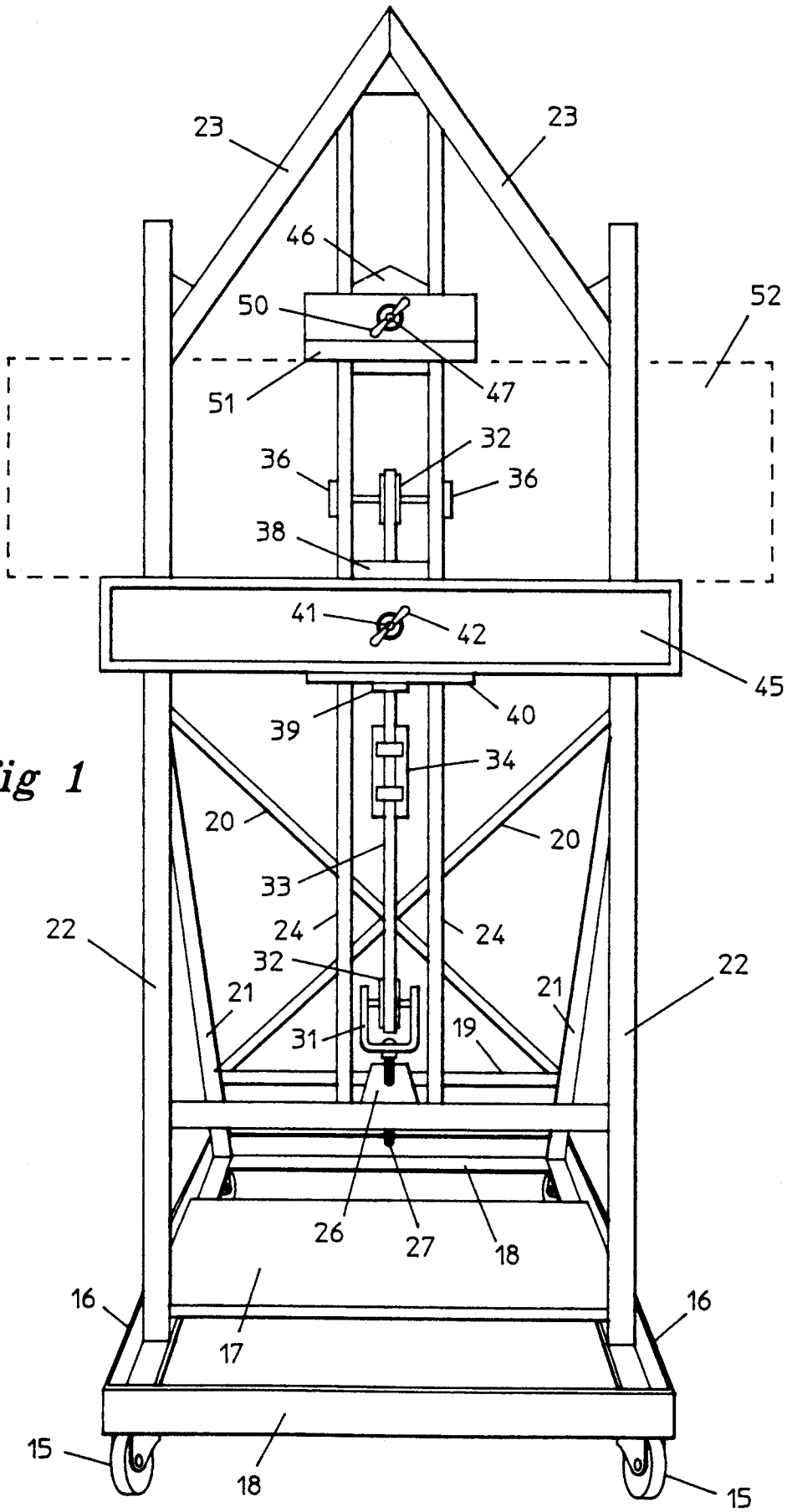
Figure 4:
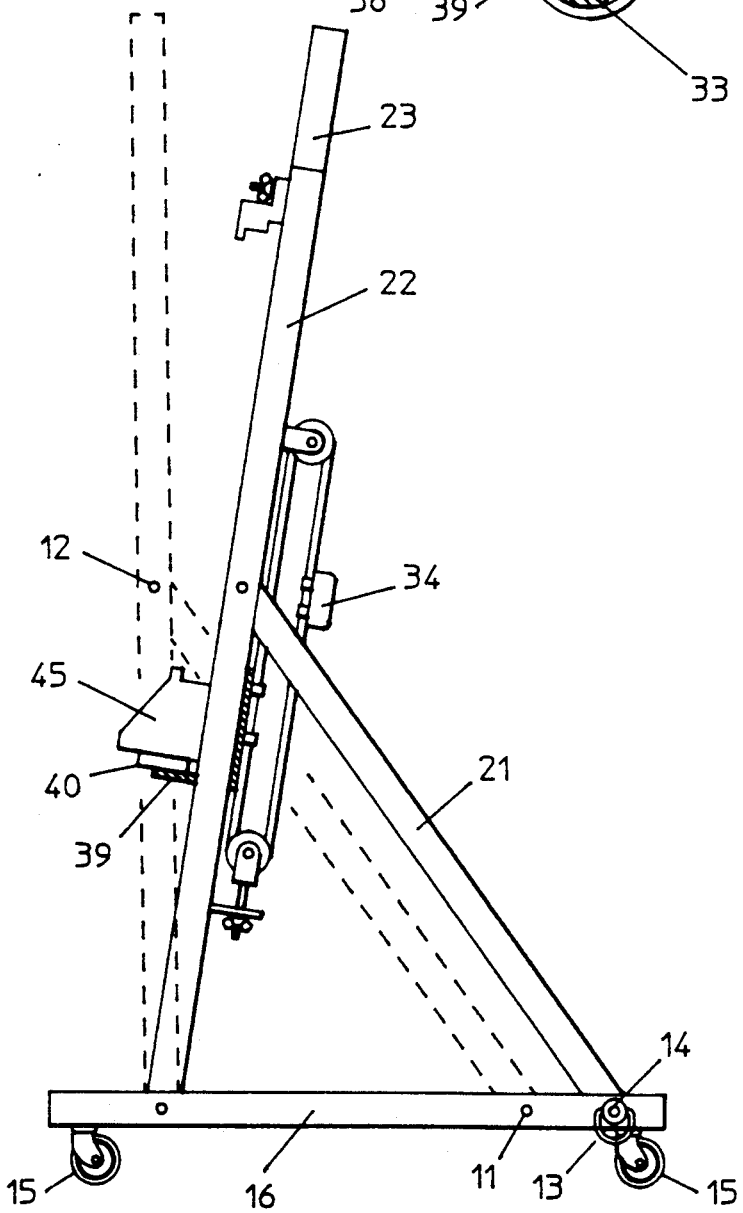
FIG. 4 is a side view of the standard in the incline position.

Referring to FIG. 1 and 4 a rectangular horizontal base frame assembly is formed by a pair of horizontal base frame members 16 and a pair of horizontal base ends members 18 and a base support shelf 17, and is provided with casters 15 or other suitable wheels or rollers so that the easel can be moved without any trouble.

This horizontal rectangular base frame assembly supports a pair of upright segments 22 in an upright position along with a pair of incline segments 21 connecting to upright segments 22 at a pivot point 12 and the opposite ends of incline segments 21 connects to horizontal base frame members 16 in holes 11 for vertical position and holes 14 for incline position of standard and fastened by a pair of quick release pins 13.

A pair of cross brace members 20 and a rear brace member 19 supports and fastens to opposite ends of incline segments 21 respectively, forming an incline cross brace assembly supporting standard in upright position.

A cross bar 25 fixed between the lower ends of upright segments 22 whereon a pair of parallel vertical angle bars 24 spaced apart connects at mid-center of cross bar 25.

Near the top a pair of brace members 23 connects near the upper ends of upright segments 22 and converging upwards connects the top ends of vertical angle bars 24 and then their ends terminate together in a triangle fashion.

Figures 2, 3:
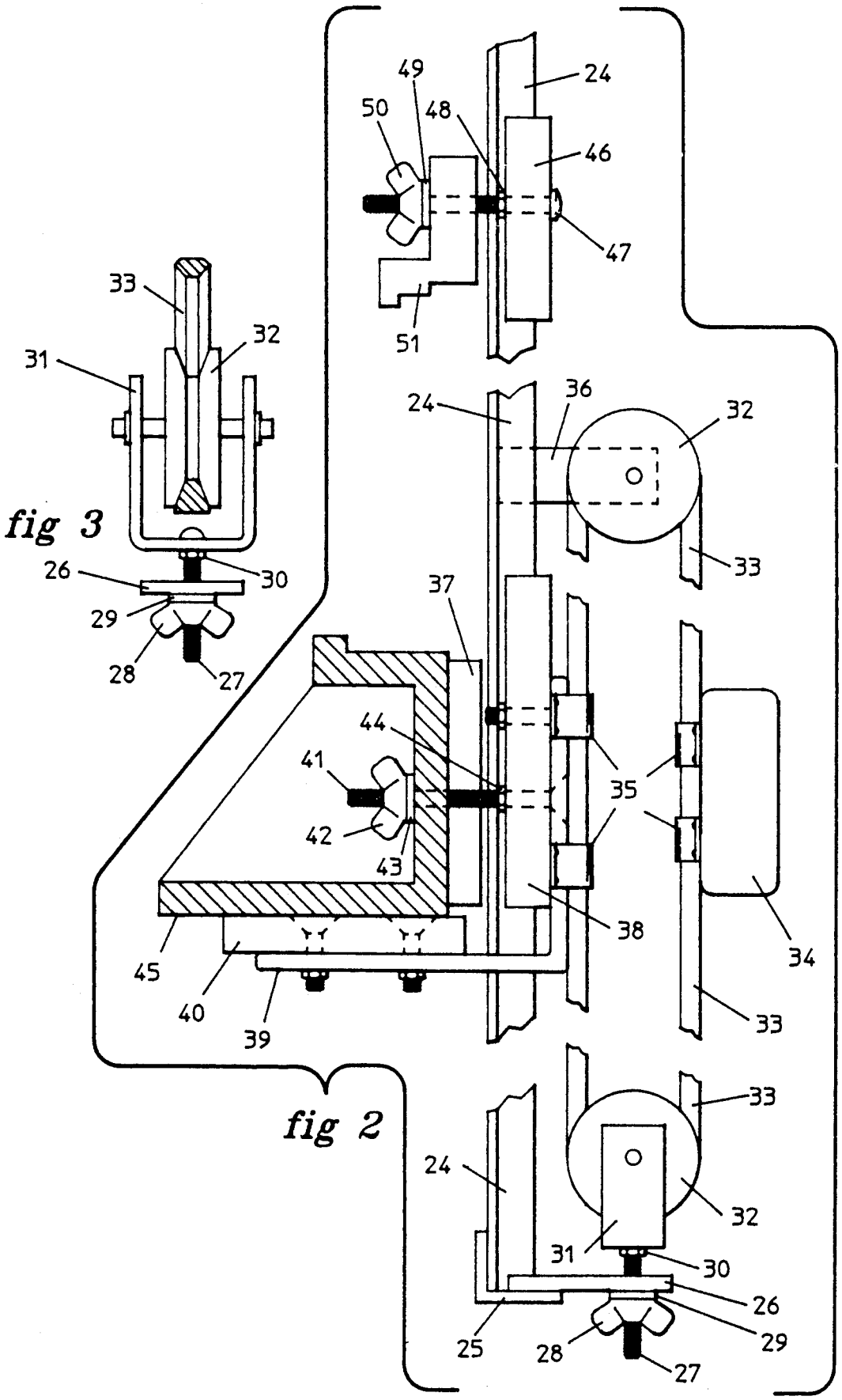
FIG. 2 is a fragmentary side view of the top canvas holder and canvas tray holder in position and relative to the "V" belt assembly and channel formed by the angle bars.
FIG. 3 is a front fragmentary view of the "V" belt in the lower pulley cradled in the "U" bracket.

FIGS. 1, 2, and 3 show a "V" belt 33 stretched between a pair of pulleys 32 and positioned vertically between centers and plane of vertical angle bars 24.

The upper pulley 32 is mounted between a pair of top brackets 36 connected to the outer sides of vertical angle bars 24 respectively.

The lower pulley 32 is mounted in a "U" bracket 31 and a bolt 27 extending through a hole in the center and bottom of "U" bracket 31 and fastened by a nut 30 then extending through a hole in a lower bracket 26 which is connected to the center of cross bar 25 and through a washer 29 and an adjustable wing nut 28 for tension adjustment of "V" belt 33.

Figure 5:
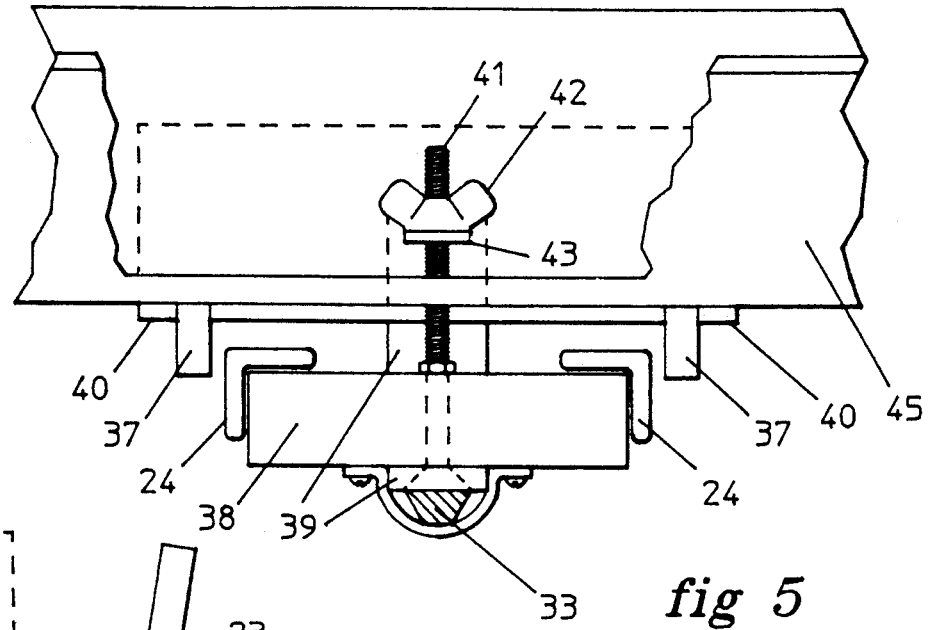
FIG. 5 is a top fragmentary view of the canvas tray holder in position and relative to the slidable block in the track formed by the angle bars.

Referring to FIGS. 2 and 5 the vertical length of an angle bracket 39 connects to the center and back side of a rectangular slidable block 38 positioned in the channel formed by vertical angle bars 24 and the horizontal length of angle bracket 39 is fastened to the center and bottom side of a canvas tray saddle block 40.

A canvas tray holder 45 rests on the top side of canvas tray saddle block 40 and held in the center position by a pair of tray vertical guides 37 which are spaced apart slightly larger than the outside distance of the two vertical angle bars 24.

Canvas tray holder 45 is held in the adjustable relative position to rectangular slidable block 38 by a bolt 41 extending through the center of the vertical length of angle bracket 39 and forward through the center of rectangular slidable block 38 and fastened by a nut 44 and forward again through the center of the vertical plane of canvas tray holder 45 and a washer 43 and an adjustable wing nut 42 for clamping canvas tray holder 45 against upright segments 22 at any desired height if desired.

Referring to FIGS. 1 and 2 "V" belt 33 is attached to the back side of rectangular slidable block 38 by a pair of clamps 35 and opposite this point circumferencewise a counter-balanced weight 34 is fastened to "V" belt 33 by a pair of clamps 35.

Canvas tray holder 45 is now in equilibrium and can be positioned at any desired height by simply pushing up or pushing down on the center of canvas tray holder 45. However, adjustable wing nut 42 is ideal to grasp for this purpose.

A top canvas holder 51 is held in place by a bolt 47 passing through the center of a top slidable block 46 which is positioned in the channel formed by vertical angle bars 24 and fastened by a nut 48 then extending forward through the center of top canvas holder 51 and a washer 49 and an adjustable wing nut 50 for clamping top canvas holder 51 against vertical angle bars 24 at any desired height if desired.

This easel disclosed herein is strong, very stable and rugged and can be completely disassembled for shipment or partially disassembled for storage if desired.

Be it known that various changes and modifications may be made in the above construction of the easel and as to such changes in size, shape and various arrangements of parts without departing from the spirit of the invention or the scope of the sub-joined claim.

I claim:

1. An artist's easel, comprising:

a base, a vertical upright frame, and a canvas tray holder, said base and said frame supporting said canvas tray holder in equilibrium, a rectangular horizontal base frame having casters, said upright frame being mounted on said rectangular horizontal base frame, a base support shelf positioned between said horizontal base frame members with a plurality of holes at the back ends of said horizontal base frame members for vertical or inclined positioning of said upright frame, a cross brace and a rear brace member having thereon a pair of inclined segments supporting said upright segments and connected at pivot points to said upright segments, the opposite ends of said inclined segments connected to holes on said horizontal base frame members, respectively, and secured by a pair of quick release pins, a crossbar fixed between and near the lower ends of said upright segments, a pair of parallel spaced apart vertical angle bars connected at mid-center of said crossbar and near the top ends of said upright segments, a pair of brace members being connected to said upright segments, respectively, and converging upwardly to the top ends of said vertical angle bars, respectively, and then terminating together in a triangular fashion, a continuous endless V-belt stretched between a pair of pulleys and positioned vertically between the center and plane of said vertical angle bars, a top one of said pulleys being connected by brackets to each outer side of said vertical angle bars, respectively, and a lower one of said pulleys being mounted in a U-bracket, a fastening member from the base of said U-bracket extending through a hole in a lower bracket mounted at midpoint of said crossbar and secured by an adjustable member for adjusting tension on said V-belt, a rectangular slidable block positioned in said channel formed by said vertical angle bars and connected to the front length of said V-belt, and circumferentially opposite this point is an attached counterbalanced weight, an angle bracket having vertical and horizontal portions, said vertical portion being attached to the back side of said rectangular slidable block, said horizontal portion being attached to the center and bottom side of a canvas tray saddle block, a canvas tray holder resting on the top side of said canvas tray saddle block, an adjustable fastening member extending forward through centers of said vertical portion of said angle bracket and said rectangular slidable block and the vertical plane of said canvas tray holder, respectively, for braking and clamping action between surface of said canvas tray holder against the surfaces of said upright segments, and between the surface of said rectangular slidable block and against the inside channel surfaces formed by said angle bars, a top canvas holder connected to a top slidable block positioned in said channel formed by said vertical angle bars, said top canvas holder being connected to said top slidable block by a releasable fastening member extending through the center of said top slidable block and forward through the center of said top canvas holder, clamping said top canvas holder to said vertical angle bars at any desired height, whereby said canvas tray holder will remain in equilibrium at all times, regardless of the weight applied thereon, up to a reasonable limit, without having to add to said fixed counterbalanced weight, and whereby said canvas tray holder can easily be moved to different working heights during the day, giving the artist the opportunity to move from standing to sitting positions at will and without awkward time-consuming mechanical heights adjustments.

* * * * *